US009890559B2

(12) United States Patent
Lai

(10) Patent No.: US 9,890,559 B2
(45) **Date of Patent: *Feb. 13, 2018**

(54) PADLOCK WITH FULLY INTEGRATED DUAL LOCKING MECHANISM WITH RESET MECHANISM

(71) Applicant: The Sun Lock Company Ltd., Tuen Mun, N.T. (HK)

(72) Inventor: Karl Lai, Tai Po (HK)

(73) Assignee: The Sun Lock Company, Ltd., Tuen Mun, N.T. (HK)

( * ) Notice: Subject to any disclaimer, the term of this patent is extended or adjusted under 35 U.S.C. 154(b) by 129 days.

This patent is subject to a terminal disclaimer.

(21) Appl. No.: 15/015,269

(22) Filed: Feb. 4, 2016

(65) Prior Publication Data

US 2016/0281388 A1 Sep. 29, 2016

Related U.S. Application Data

(60) Provisional application No. 62/138,135, filed on Mar. 25, 2015.

(51) Int. Cl.
*E05B 37/02* (2006.01)
*E05B 37/00* (2006.01)
(Continued)

(52) U.S. Cl.
CPC ..... *E05B 37/025* (2013.01); *E05B 37/0034* (2013.01); *E05B 67/02* (2013.01);
(Continued)

(58) Field of Classification Search
CPC .. E05B 37/00; E05B 37/0031; E05B 37/0034; E05B 37/0048; E05B 37/0058;
(Continued)

(56) References Cited

U.S. PATENT DOCUMENTS 1,653,254 A 12/1927 Chisholm
1,728,902 A 9/1929 Cohen
(Continued)

FOREIGN PATENT DOCUMENTS

CN 101315007 12/2008
EP 1837466 9/2007
(Continued)

OTHER PUBLICATIONS

Search Report issued by the GB Intellectual Property Office dated Mar. 15, 2016 in counterpart GB application No. GB1516376.9 (1 page).

(Continued)

*Primary Examiner* — Christopher J Boswell
(74) *Attorney, Agent, or Firm* — Ware, Fressola, Maguire & Barber LLP

(57) ABSTRACT

A dual locking padlock having a code locking mechanism and an overriding mechanism is disclosed. The housing has a top body, a stack of dials and clutches mounted on a bottom body, and a spindle engaging with the clutches. The spindle has a channel to store the heel of a shackle. An upward movement of the spindle allows the shackle to be pulled upward to unlock the padlock. Each dial has a plurality of teeth with slope-like surfaces to engage with the wave slots of a clutch. Clutches are rotatable relative to the spindle only when the lock is in the locked mode along with the dials. In the opened mode, a dial can be turned relative to a clutch by disengaging the teeth from wave-slots. The spindle is allowed to move upward either when a correct combination code is used or when a key activates the overriding mechanism.

15 Claims, 12 Drawing Sheets

(51) Int. Cl.

| | |
|---|---|
| ***E05B 67/02*** | (2006.01) |
| ***E05B 67/22*** | (2006.01) |
| ***E05B 67/08*** | (2006.01) |
| ***E05B 67/24*** | (2006.01) |

(52) U.S. Cl.
CPC ..... *E05B 67/08* (2013.01); *E05B 67/22* (2013.01); *E05B 67/24* (2013.01); *E05B 37/0058* (2013.01)

(58) Field of Classification Search
CPC .... E05B 37/0068; E05B 37/02; E05B 37/025; E05B 67/00; E05B 67/06; E05B 67/22; E05B 67/24
See application file for complete search history.

(56) References Cited

U.S. PATENT DOCUMENTS

| | | | | |
|---|---|---|---|---|
| 4,444,029 | A | 4/1984 | Remington | |
| 4,733,548 | A | 3/1988 | Ling | |
| 4,829,794 | A | 5/1989 | Crown | |
| 5,715,709 | A | 2/1998 | Lai | |
| 6,029,481 | A | 2/2000 | Lai | |
| 6,176,109 | B1 | 1/2001 | Tsui | |
| 6,474,116 | B1 | 11/2002 | Lai | |
| 6,675,614 | B2 | 1/2004 | Lai | |
| 6,729,166 | B1 | 5/2004 | Lai | |
| 6,883,355 | B2 | 4/2005 | Lai | |
| 6,904,776 | B1 | 6/2005 | Lin | |
| 7,117,698 | B2 | 10/2006 | Lai | |
| 7,121,123 | B2 | 10/2006 | Yu | |
| 7,140,209 | B2 | 11/2006 | Lai | |
| 7,155,944 | B1 | 1/2007 | Lin | |
| 7,225,648 | B2 | 6/2007 | Lai et al. | |
| 7,370,498 | B1 | 5/2008 | Miao | |
| 7,467,531 | B2 | 12/2008 | Lai et al. | |
| 7,523,628 | B2 * | 4/2009 | Yu | E05B 37/0034 70/21 |
| 7,562,545 | B2 | 7/2009 | Lai et al. | |
| 7,685,851 | B2 | 3/2010 | Lai | |
| 7,765,840 | B2 | 8/2010 | Lai et al. | |
| 7,775,073 | B2 * | 8/2010 | Green | E05B 37/025 70/22 |
| 8,261,583 | B2 | 9/2012 | Lai et al. | |
| 8,511,118 | B2 | 8/2013 | Lai et al. | |
| 8,661,861 | B2 | 3/2014 | Lai | |
| 8,776,556 | B2 | 7/2014 | Lai | |
| 8,881,558 | B2 | 11/2014 | Misner et al. | |
| 8,919,155 | B2 | 12/2014 | Lai | |
| 8,931,313 | B2 | 1/2015 | Lai | |
| 8,966,946 | B2 | 3/2015 | Lai | |
| 9,206,625 | B2 | 12/2015 | Lai | |
| 9,464,460 | B2 * | 10/2016 | Lai | E05B 37/14 |
| 9,556,650 | B1 * | 1/2017 | Lai | E05B 37/025 |
| 2003/0150245 | A1 | 8/2003 | Lai | |
| 2004/0031298 | A1 | 2/2004 | Lai | |
| 2005/0092036 | A1 | 5/2005 | Lai | |
| 2006/0027000 | A1 | 2/2006 | Yu | |
| 2006/0027001 | A1 | 2/2006 | Lai | |
| 2006/0150690 | A1 | 7/2006 | Lai et al. | |
| 2006/0243005 | A1 | 11/2006 | Lai et al. | |
| 2006/0260369 | A1 | 11/2006 | Lai et al. | |
| 2008/0011025 | A1 | 1/2008 | Lin | |
| 2008/0083251 | A1 | 4/2008 | Lai et al. | |
| 2008/0098774 | A1 | 5/2008 | Huang | |
| 2008/0250825 | A1 | 10/2008 | Lai | |
| 2009/0113947 | A1 | 5/2009 | Lai et al. | |
| 2012/0304711 | A1 | 12/2012 | Misner et al. | |
| 2013/0025333 | A1 | 1/2013 | Lai | |
| 2013/0036778 | A1 | 2/2013 | Lai | |
| 2013/0118215 | A1 | 5/2013 | Lai | |
| 2014/0026626 | A1 | 1/2014 | Lai | |
| 2014/0250952 | A1 | 9/2014 | Lai | |
| 2014/0352371 | A1 | 12/2014 | Lai | |
| 2014/0366592 | A1 | 12/2014 | Bao et al. | |
| 2014/0373579 | A1 | 12/2014 | Lai | |
| 2015/0322692 | A1 | 11/2015 | Lai | |
| 2015/0330104 | A1 | 11/2015 | Lai | |
| 2017/0009488 | A1 * | 1/2017 | Lai | E05B 37/0058 |
| 2017/0073999 | A1 * | 3/2017 | Lai | E05B 37/0031 |

FOREIGN PATENT DOCUMENTS

| | | |
|---|---|---|
| EP | 2738326 | 6/2014 |
| GB | 203929 | 9/1923 |
| GB | 2493266 | 1/2013 |
| GB | 2498242 | 7/2013 |
| GB | 2519128 | 4/2015 |
| JP | 07305553 | 11/1995 |
| JP | 2011168983 | 9/2011 |
| TW | M247658 | 10/2004 |

OTHER PUBLICATIONS

Examination Report issued by the GB Intellectual Property Office dated Mar. 15, 2016 in counterpart GB application No. GB1516376.9 (4 pages).
International Search Report dated Oct. 12, 2015 in counterpart international application No. PCT/IB2015/053122 (4 pages).

* cited by examiner

PADLOCK WITH FULLY INTEGRATED DUAL LOCKING MECHANISM WITH RESET MECHANISM

CROSS REFERENCE TO RELATED PATENT APPLICATION

This application claims priority under 35 USC § 119 to U.S. Provisional Patent Application No. 62/138,135, filed Mar. 25, 2015, whose entire contents are hereby incorporated by reference.

TECHNICAL FIELD

The present invention relates to padlocks, in particular a padlock with a dual locking mechanism.

BACKGROUND OF THE INVENTION

Numerous padlock constructions have been developed and are widely employed to prevent unauthorized persons from gaining access to any particular item or area which has been closed and locked. Although many locks are constructed to be opened by a key, numerous combination lock constructions have been developed which are opened by knowledge of a particular combination.

One particular type of combination lock that has become very popular due to its ease and convenience of use is a combination lock which employs a plurality of rotatable independent dials, each of which forms one of the indicia, usually numerals or letters, which comprise the combination for releasing the lock. Typically, the combination lock has one mode or position in which the user is able to set or reset the desired combination sequence.

In airplane travel, new regulations and requirements allow customs officers or transit security personnel to physically break any padlock in order to gain access to luggage which is deemed suspicious. Under these new security regulations, all luggage must be scanned or inspected to prevent the transportation of potentially dangerous items or products which are deemed to be undesirable. Currently a padlock may have two separate and independent locking systems, with both locking systems independently enabling a single shackle to be released and/or lockingly engaged. In this way, by employing either a key activation zone or a combination activation zone, the padlock can be opened. The key activation zone allows security personnel to open the padlock with a master key and then re-lock the padlock in place after the inspection has been completed.

SUMMARY OF THE INVENTION

The present invention provides a dial padlock with dual locking mechanism. The padlock can be opened by a combination code or by a key-overriding mechanism.

One aspect of the present invention is a padlock operable in a locked mode and in an opened mode, comprising:

a shackle having a heel and a toe;

a lock housing configured to store the heel of the shackle, the lock housing comprising a top portion, a middle portion and a bottom portion, wherein the heel of the shackle can be partially released from the lock housing from a first shackle position to a second shackle position;

a spindle disposed inside the lock housing and arranged to provide a code locking mechanism, the code locking mechanism configured to operate the padlock in the locked mode or in the opened mode based on a combination code;

a plurality of clutches rotatably mounted on the cylindrical surface of the spindle;

a plurality of dials mounted in the middle portion of the lock housing in relationship to the clutches to form the combination code; and an overriding mechanism disposed in relationship to the spindle, the overriding mechanism activatable to cause the padlock to operate in the opened mode, wherein the shackle is in the first shackle position when the padlock is operated in the locked mode, and the shackle is in the second shackle position when the padlock is operated in the opened mode, wherein each of the clutches comprises an extended outer ring having thereon a plurality of clutch slots, and each of the dials comprises an extended inner ring having thereon a plurality of teeth arranged to engage with said plurality of clutch slots of a clutch so as to control rotational movement of said clutch relative to the spindle.

According to an embodiment of the present invention, the heel of the shackle comprises a neck area, and said padlock further comprises a latch having a fork arranged to engage the neck area of the heel so as to prevent the shackle from moving away from the first shackle position when the padlock is operated in the locked mode.

According to an embodiment of the present invention, the spindle comprises a spindle channel for storing the heel, the spindle channel having a channel portion for storing part of the neck area of the heel, and the latch is disposed in relationship to the channel portion, and the spindle further comprises a cam arranged to engage the latch so as to keep the fork in an engaging relationship with the neck area of the heel.

According to an embodiment of the present invention, the overriding mechanism can be activated by a key, causing the cam to disengage the fork of the latch from the neck area of the heel, allowing the shackle to move from the first shackle position to the second shackle position.

According to an embodiment of the present invention, the bottom portion of the lock housing comprises a bottom body, and the spindle is movably mounted on the bottom body such that the spindle can be caused to move upward toward the top portion of the lock housing in a vertical movement from a first spindle position to a second spindle position, and each of the clutches has an inner surface and an extended inner ring extended from the inner surface, the extended inner ring having a ring thickness and an opening gap made on the extended inner ring through the ring thickness, and the spindle comprises a plurality of extended protrusions, each extended protrusion associated with a clutch such that the extended inner ring of the clutch prevents the spindle from moving upward when the extended protrusion is misaligned with the opening gap of the associated clutch.

According to an embodiment of the present invention, when the padlock is operated in the locked mode, the dials can be rotated relative to the spindle to change the combination code and the clutches are caused to rotate along with the dials, such that when the combination code matches a predetermined code, the opening gap of each of the clutches aligns with an associated extended protrusion of the spindle, allowing the spindle to move from the first spindle position to the second spindle position when the shackle is pulled upward from the first shackle position to the second shackle position, causing the padlock to operate in the opened mode.

According to an embodiment of the present invention, the plurality of dials form a dial stack comprising a first dial and a last dial, the last dial positioned in contact to the bottom body of the lock housing, and the top portion of the lock housing comprises a top body mounted on the first dial and a spacer fixedly mounted on the top body between the top body and the spindle, the spacer having a shackle hole dimensioned to receive the heel of the shackle, the top body comprising a locking hole and a top body hole, the locking hole dimensioned to receive the toe of the shackle, the top body hole in communication with the shackle hole of the spacer and the spindle channel of the spindle for placement of the heel of the shackle.

According to an embodiment of the present invention, the shackle hole of the spacer has an inner surface and an extended ring extended therefrom, the extended ring having a shackle-protrusion slot made thereon and a ring surface facing the top body, wherein the spacer has a cutout zone dimensioned to receive the spindle, allowing the spindle to move between the first spindle position and the second spindle position, and the heel of the shackle has a shackle protrusion positioned in relationship to the shackle-protrusion slot such that when the shackle is in the first shackle position, the shackle protrusion is located between the extended ring and the spindle, and when the shackle is pulled upward from the first shackle position to the second shackle position, the shackle protrusion moves through the shackle-protrusion slot so that when the spindle is in the second spindle position, the shack protrusion is located in the shackle hole between the extended ring and the top body.

According to an embodiment of the present invention, when the padlock is operated in the opened mode, the shackle can be rotated so as to move the toe of the shackle away from the locking hole of the top body and to move the shackle protrusion away from the shackle-protrusion slot, and when the shackle protrusion is moved away from the shackle-protrusion slot, the extended ring of the spacer prevents the shackle from moving downward.

According to an embodiment of the present invention, when the spindle is in the second spindle position, each of the extended protrusion of the spindle is engaged with the opening gap of one of the clutches, preventing the clutches from rotating relative to the spindle.

According to an embodiment of the present invention, when the spindle is in the second spindle position, the dials can be rotated relative to the clutches to change the combination code.

According to an embodiment of the present invention, each of the dials has an outer ring arranged for placing a plurality of symbols to form the combination code, the outer ring dimensioned to receive a clutch, and each of the dials is associated with one of the clutches to form a dial-clutch assembly, each dial-clutch assembly comprising a separation ring positioned within the outer ring of the dial, and a helical spring positioned within the outer ring between the separation spring and extended outer ring of the clutch, such that when the dial in a dial-clutch assembly is rotated relative to the clutch, the teeth of the dial are configured to push the clutch toward separating ring and to compress the helical spring so as to allow the teeth to disengage from the clutch slots.

According to an embodiment of the present invention, each of the teeth has a slope-like surface on both sides of the tooth and each of the clutch slots also has a slope-like surface on both side of the clutch so as to facilitate rotation of the dial relative to the clutch in a dial-clutch assembly.

According to present invention, the spindle further comprises a ratchet slot spaced from the extended protrusions of the spindle, the ratchet slot dimensioned to receive a ratchet plate having a plurality of tips, and the inner surface of each of the clutches has a plurality of ratchet-receiving slots arranged to engage with one of the tips of ratchet plate so as to produce a clicking sound when the clutch is rotated relative to the spindle.

According to the present invention, the extended inner ring of each of the clutches further comprises a plurality of faulty notches made through a part of the ring thickness, the faulty notches spaced from the opening gap, such that when the extended protrusion of spindle is misaligned with the opening gap of the associated clutch, the extended protrusion of the spindle is in contact to one the faulty notches on the associated clutch.

According to an embodiment of the present invention, the bottom body comprises a plurality of screw holes, the spindle has a cylindrical surface and a plurality of screw passing slots on the cylindrical surface, and the spacer further comprises a plurality of screw receiving holes, and the lock housing further comprises screws arranged to fasten the spacer to the screw holes on the bottom body via the screw receiving holes of the spacer through the screw passing slots of the spindle.

DETAILED DESCRIPTION OF THE INVENTION

Figure 1A:
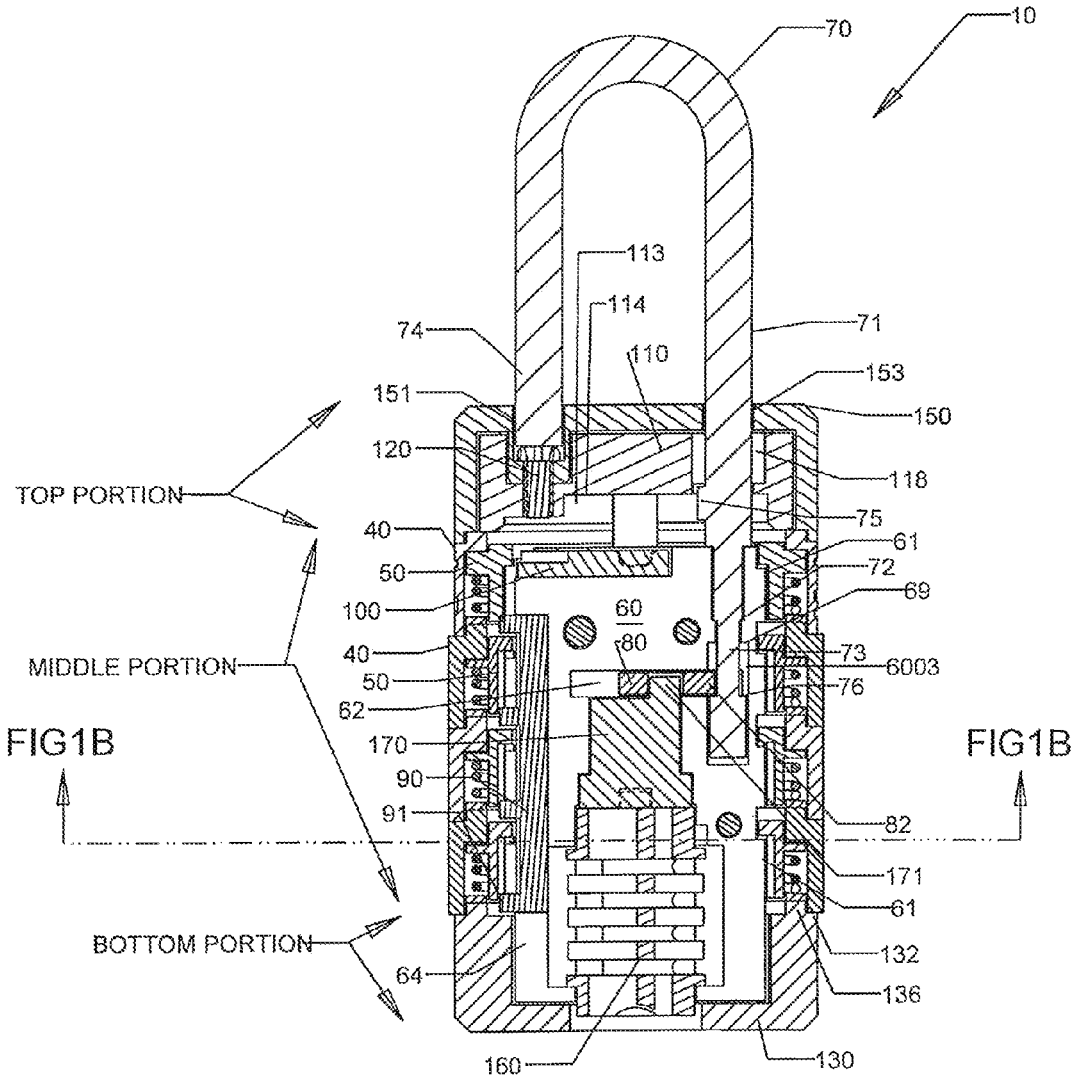
FIG. 1A shows a cross sectional side view of the padlock in a locked mode.
Figure 1B:
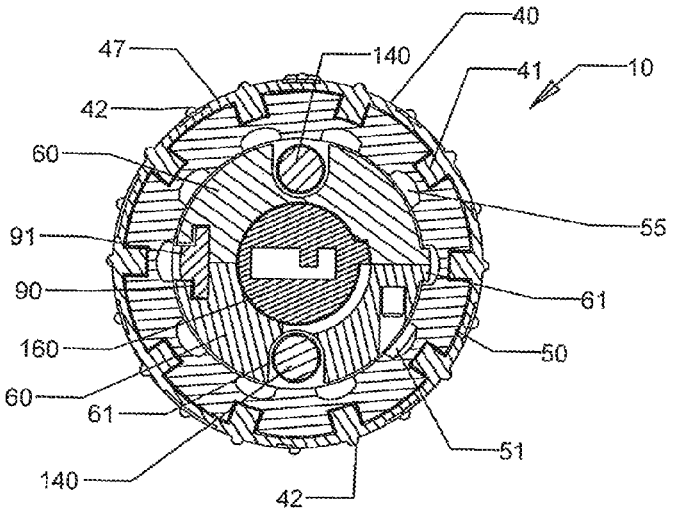
FIG. 1B shows a cross sectional bottom view of the padlock of FIG. 1A.

As seen in FIGS. 1A-5, 13A-14B, the present invention is directed to a dial padlock with dual locking mechanism, which is encased in a lock housing. The padlock 10 can be opened by a combination code and by a key operating mechanism. The lock housing has three portions: a top portion, a middle portion and a bottom portion. The top portion includes a top body 150; the middle portion includes a stack of dials 40 and clutches 50; and the bottom portion includes a bottom body 130. The lock housing is configured to store the long leg 71 (heel) of shackle 70. The dual locking mechanism includes a spindle 60. The spindle 60 is located inside the lock housing to provide a code locking mechanism in order to keep the padlock in the locked mode based on a combination code. The spindle 60 has a substantially cylindrical surface 6001 and a plurality of extended protrusions 61 extended from the cylindrical surface 6001. The code locking system is controlled by dials 40 which cause the rotational movement of the clutches 50. When all dials 40 are turned to the preset lock-open combination, all the clutches are turned such that the opening gap 51 of each clutch 50 aligns with an extended protrusion 61 of the spindle 60. The opening gap 51 is made through the thickness of an extended inner ring 58 of clutch 50. The alignment between the opening gaps 51 and the extended protrusions 61 allows the user to pull the spindle 60 upward (away from the bottom portion of the lock housing) to place the padlock 10 in an opened mode. The spindle 60 has a spindle channel 6002 for placing the long-leg 71 of shackle 70 in the lock housing. The spindle channel 6002 has a lower channel portion 6003 with a stop wall 69. The long leg 71 of shackle 70 has a neck area 73 with an upper surface 72 and a lower surface 76. The neck area 73 of the long leg 71 is partially located in the lower channel portion 6003 of spindle 60 with the end of the long leg 71 of shackle 70 being located in the proximity of the bottom of the lower channel portion 6003. The spindle 60 has a latch channel 62 made into part of the lower channel 6003. The latch channel 62 is dimensioned for placing a latch 80 between the upper surface 72 and lower surface 76 of the neck area 73 of shackle 70. The latch 80 has a fork 82.

In the combination-open mode and in the locked mode, the fork 82 of latch 80 always engages the lower surface 76 of the neck area 73 of shackle 70. The latch 80 is placed inside a latch channel 62 of spindle 60. As such, the shackle 70 and the spindle 60 are pulled up and pushed down together.

In the key-open mode, the lower surface 76 of the neck area 73 of shackle 70 and the stop wall 69 in the lower channel portion 6003 limit the upward movement of shackle 70.

An advantage of the padlock, according to the present invention, is the reset mechanism. Once the user has opened the padlock by a combination code, the user can turn the dials 40 to set a new combination with or without rotating the shackle 70. As seen below, when the padlock 10 is in the locked mode, the clutches 50 are disengaged from the spindle 60 and, therefore, move easily along with the dials 40 in a rotation movement relative to spindle 60. However, when the padlock 10 is in the reset mode, the clutches 50 are engaged with the spindle 60 and the clutches 50 are prevented from rotating when the dials 40 are turned. Thus, the user must use a stronger force to turn the dials in the reset mode than the force to turn the dials in the locked mode.

Figure 2A:
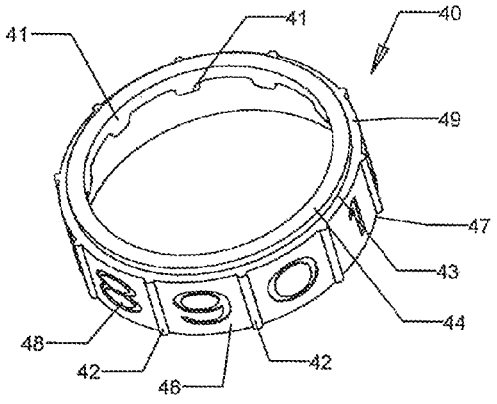
FIGS. 2A and 2B show different views of a dial.
Figure 2B:
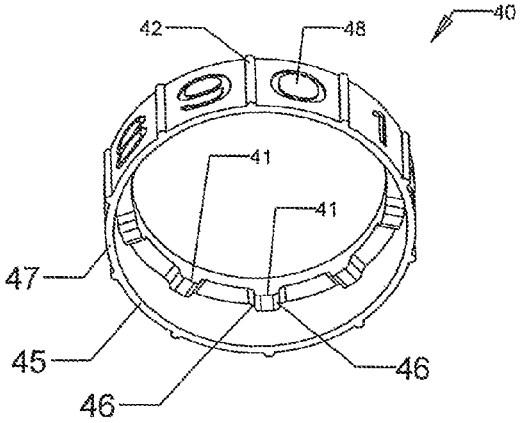

Another feature of this lock is the anti-peek function. As shown in FIGS. 2A and 2B, each dial 40 has an extended inner ring 43 with a ring surface 44, and an outer ring 47 with a bottom surface 45. As the dials 40 are stacked one upon another, the extended inner ring 43 of the lower dial 40 is placed inside the lower end of outer ring 47 of the dial 40 directly above, with the bottom surface 45 of the lower dial 40 contacting the top surface 49 of the upper dial 40. The last dial 40 is also placed over the contact surface 132 of bottom body 130. In addition, the top body 150 of padlock 10 is fastened to the bottom body 130 via a spacer 110, limiting the vertical (upward and downward) movement of the dials 40. The stacking of the dials 40 blocks the view of the internal mechanism of the lock, making picking the lock difficult.

Finally, another advantage of this padlock is to allow a traveler to use the combination mechanism during a trip and allow the TSA officer to inspect the luggage by using the key operating mechanism.

Placement of Dials, Clutches, Clutch Springs and Separation Rings (FIGS. 1A-3B, 15A and 15B)

Figure 3A:
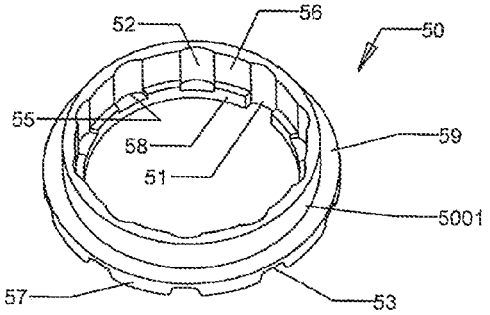
FIGS. 3A and 3B show different views of a clutch.
Figure 3B:
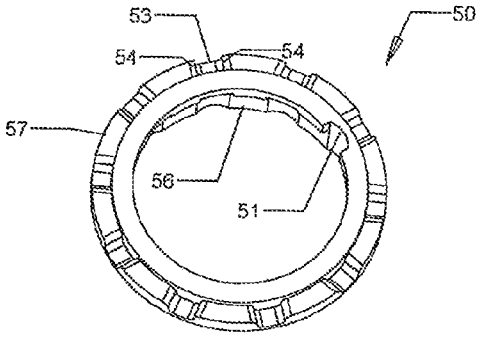
Figure 4:
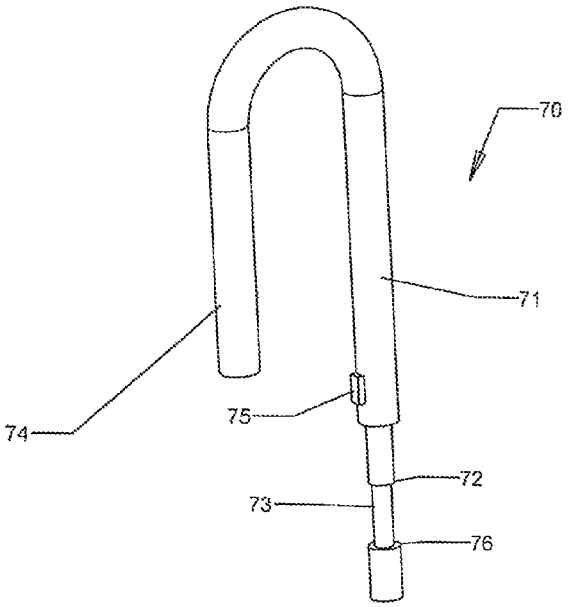
FIG. 4 is an isometric view of the shackle.
Figure 15A:
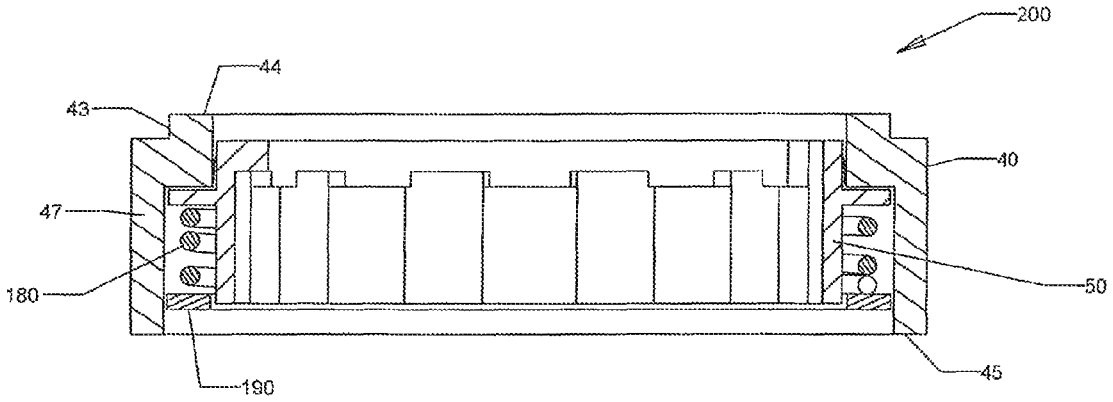
FIG. 15A is a cross sectional view of a dial-clutch assembly when the teeth of the dial are engaged in the wave-slots of the clutch.
Figure 15B:
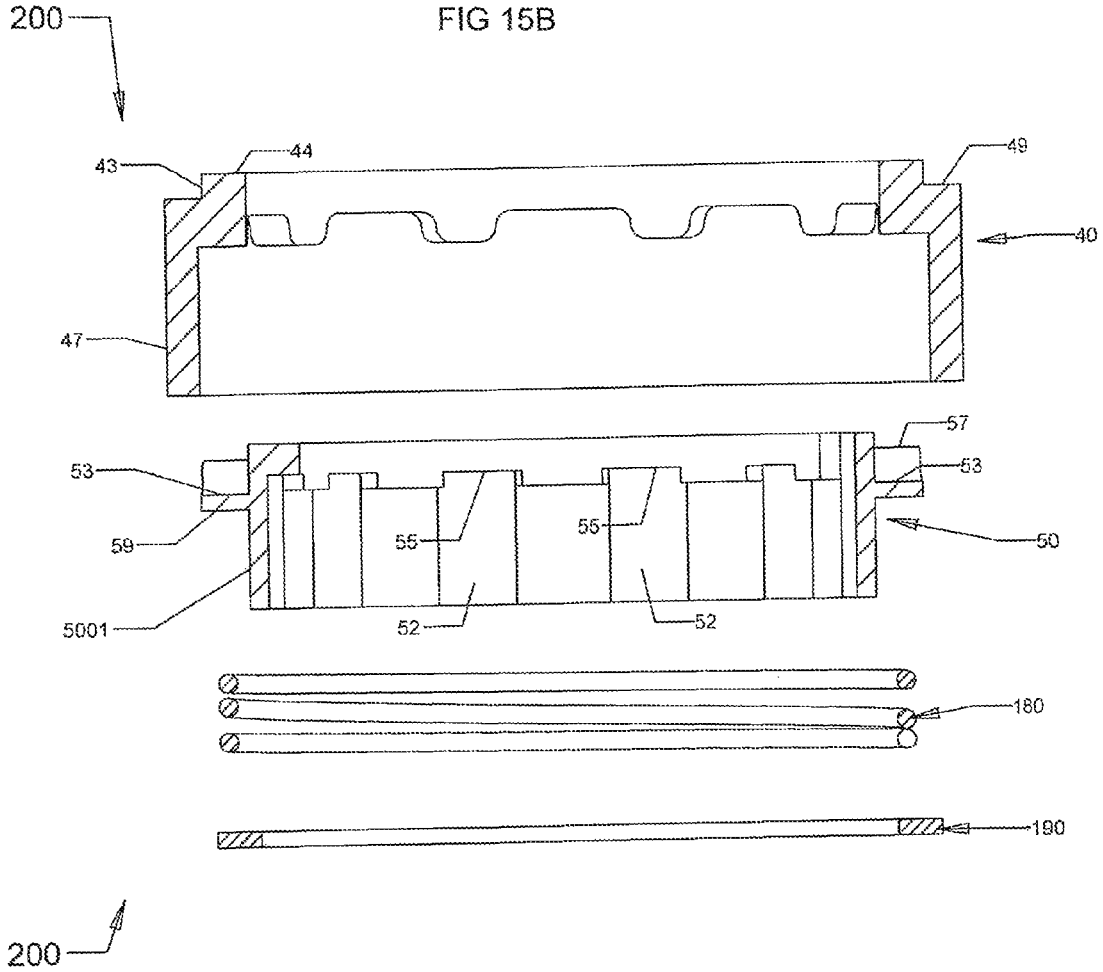
FIG. 15B is an exploded cross sectional view of the dial-clutch assembly.

As seen in FIG. 15A, each of the dials 40 is associated with a different one of the clutches 50 to form a dial-clutch assembly 200. As seen in FIGS. 2A-2B, the outer ring 47 of each dial 40 has a cylindrical outer surface with numerals or symbols 48 to form a combination code. The outer ring 47 has a bottom surface 45 and a top surface 49. The extended inner ring 43 of dial 40 joins the outer ring 47 at the top surface 49. The inner ring 43 has a ring surface 44 and a plurality of teeth 41 within the cylindrical inner surface of the outer ring 47. As seen in FIG. 3A-3B, the clutch 50 has a cylindrical body with an inner surface 56 and an outer surface 5001. The clutch 50 has an extended outer ring 57 extended from the outer surface 5001 and an extended inner ring 58 extended from the inner surface 56. The lower side of the extended outer ring 57 has a lower surface 59. The upper side of the extended outer ring 57 has a plurality of wave-slots 53 formed thereon. The wave-slots 53 of each clutch 50 are dimensioned to receive the teeth 41 of an associated dial 40. The clutch 50 has a plurality of ratchet receiving slots 52 formed on the inner surface 56. The extended inner ring 58 has a thickness. The extended inner ring 58 has an opening gap 51 formed thereon through the thickness. The extended inner ring 58 also has a plurality of faulty notches 55 made on a part of the thickness.

In each of the dial-clutch assembly 200, the teeth 41 of the dial 40 are arranged to engage with the wave-slots 53 of the clutch 50. A separation ring 190 is placed below the clutch 50 within the inner surface of the outer ring 47 of dial 40, near the bottom surface 45. A helical clutch spring 180 is placed in the space between the lower surface 59 of clutch 50 and the separation ring 190. As seen in FIG. 3B, each of the wave-slots 53 has slope-like surfaces 54 on both sides of the wave-slot 53. As seen in FIG. 2B, each of the teeth 41 also has slope-like surfaces 46 on both sides of the tooth 41 so as to facilitate the turning of the dial 40 relative to the clutch 50 in the reset mode, for example. In the padlock 10, the dial-clutch assemblies 200 are stacked one upon another to form the middle portion of the lock housing, between the top portion and the bottom portion of the lock housing.

Placement of Spindle, Dial-Clutch Assemblies, Bottom Body and Cover Plate (FIGS. 1A-1B, 6 and 13A-14B)

Figure 6:
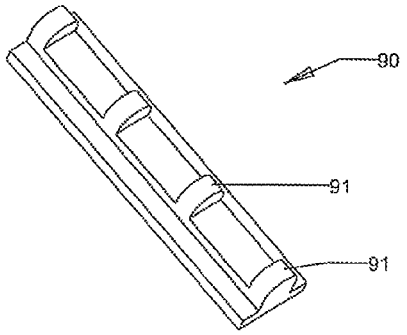
FIG. 6 is an isometric view of the ratchet plate.
Figure 7:
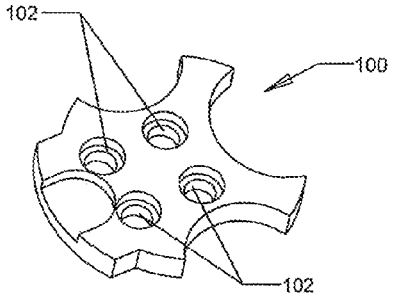
FIG. 7 is an isometric view of the cover plate.
Figure 8A:
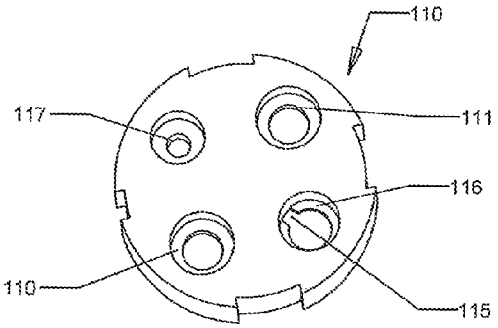
FIGS. 8A and 8B are different views of the spacer.
Figure 8B:
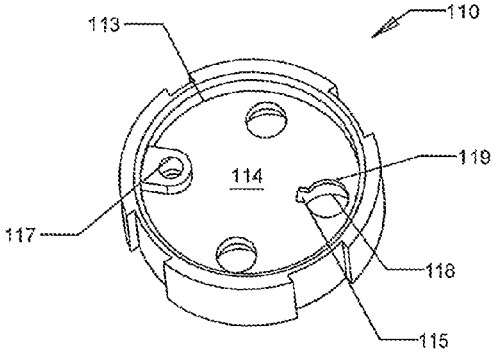
Figure 9A:
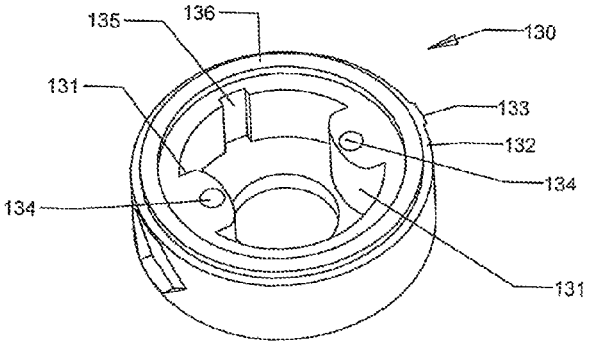
FIGS. 9A and 9B are different views of the bottom body.
Figure 9B:
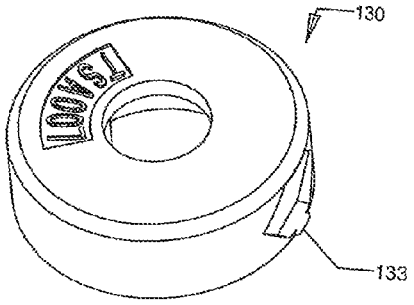
Figure 10A:
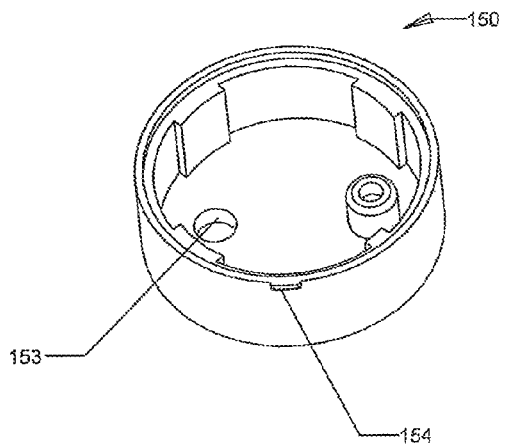
FIGS. 10A and 10B are different views of the top body.
Figure 10B:
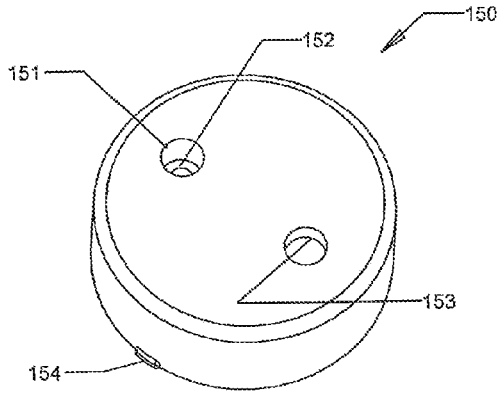
Figure 11:
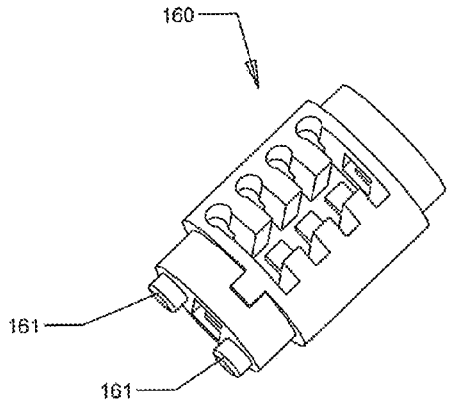
FIG. 11 is an isometric view of the cylinder.
Figure 12:
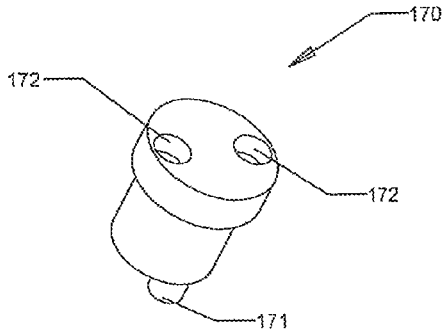
FIG. 12 is an isometric view of the cam.
Figure 13B:
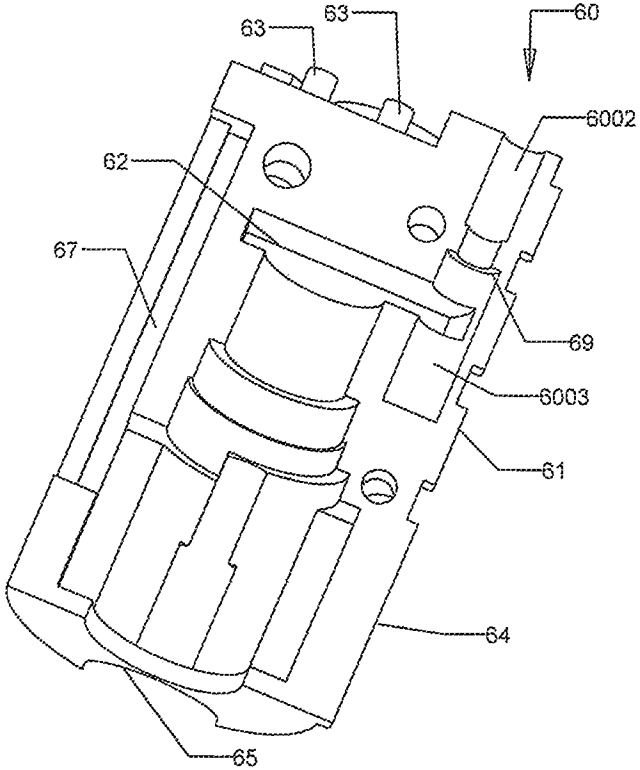
FIGS. 13A and 13B are different views of one half of the spindle.
Figure 13A:
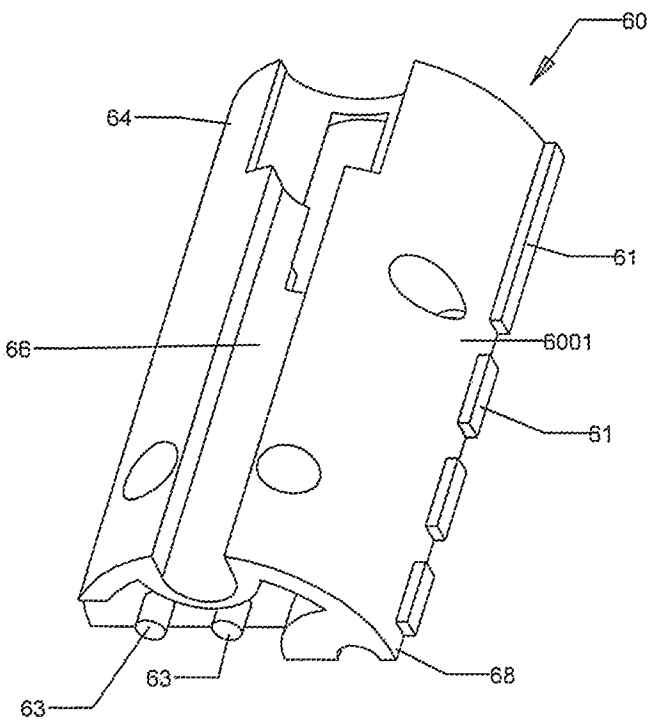
Figure 14B:
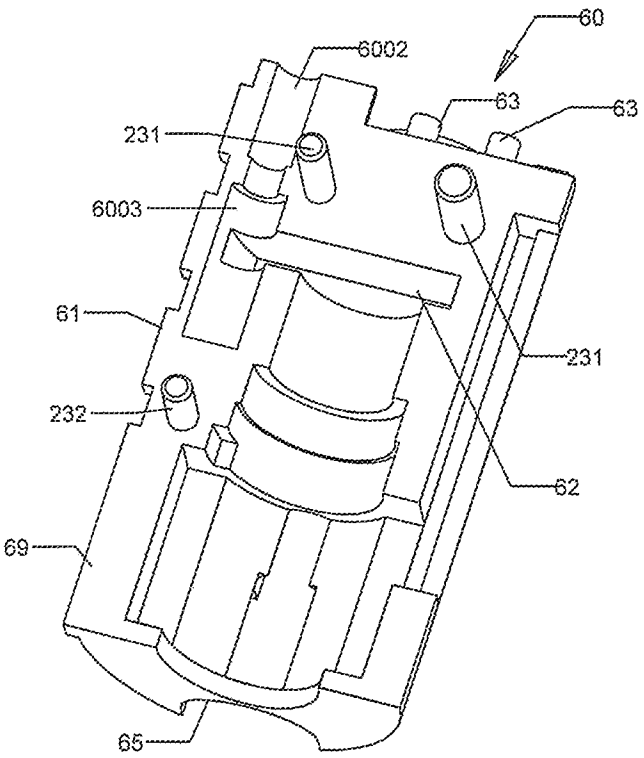
FIGS. 14A and 14B are different views of another half of the spindle.
Figure 14A:
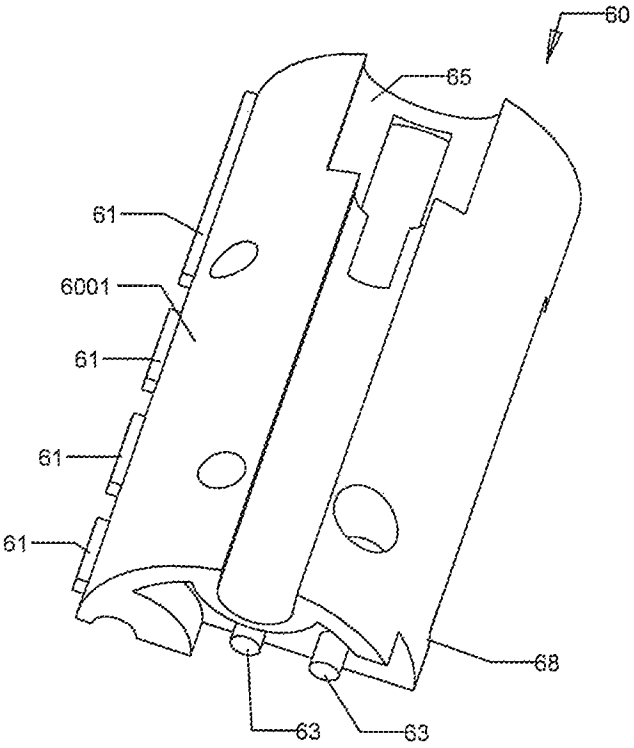

The spindle 60 is made up to two parts: one part is depicted in FIGS. 13A and 13B; and the other part is depicted in FIGS. 14A and 14B. The two parts are fastened together with rivets 231, 232 on one another inserted into mating holes on the other part after the heel or long-leg 71 of the shackle 70 has been placed in the spindle channel 6002. The spindle 60 has a ratchet slot 67 to receive a ratchet plate 90 (FIG. 6). The ratchet plate 90 has a plurality of tips 91 arranged to engage with the ratchet receiving slots 52 of clutches 50 so as to produce a clicking sound or feeling when a clutch 50 is rotated relative to the spindle 60. After the ratchet plate 90 is placed in the ratchet slot 67 of the spindle 60, a cover plate 100 with holes 102 is fastened to the top portion 68 of spindle 60 through rivets 63. As such, the ratchet plate 90 is fixedly mounted on the spindle 60.

The spindle 60 is placed inside the lock housing. In particular, the upper part of the spindle 60 resides inside the stack of dials 40 and clutches 50 and the lower part resides in the bottom portion of the lock housing. The bottom end 64 of the spindle 60 has a curved slot 65 on each half of the spindle. The bottom body 130 of the bottom portion has two curved members 131 to be placed in the curved slots 65. The bottom body 130 also has a protrusion-receiving slot 135 to receive the lower part of the bottom extended protrusion 61. Because of the restriction of the protrusion-receiving slot 135 of bottom body 130 on the bottom extended protrusion 61 of spindle 60 and the restriction of the curved slots 65 of spindle 60 on the curved members 131 of bottom body 130, the spindle 60 can only have vertical movement but no rotational movement relative to the lock housing.

Placement of Spindle, Spacer, Top Body, Dials, Clutches and Bottom Body (FIGS. 1A-3B, 8A-10B and 13B)

The spindle 60 has two screw passing slots 66. After the spindle 60 is placed inside the stack of dials 40 and clutches 50 and on the bottom body 130, a spacer 110 is placed on top of the stack of dials 40. The spacer 110 has two (can be one or more than two) holes 111 to allow screws 140 to thread onto the threaded holes 134 of the bottom body 130 after passing through the screw passing slots 66 of spindle 60. The screw passing slots 66 allow the screws 140 to be fastened to the bottom body 130 without interfering the vertical movement of spindle 60 relative to the lock housing—i.e., relative to the stack of dials 40 and clutches 50. The spacer 110 also has a shackle hole 118 dimensioned to receive the long leg 71 of shackle 70.

When the lock is in the locked mode and a user aligns the dials 40 to the indicating line 154/133 (FIGS. 9A and 10A) according to the combination code, the opening gaps 51 of clutches 50 align with the extended protrusions 61 of spindle 60. The user can pull the shackle 70 upward together with the spindle 60. The spacer 110 has a cutout zone 113 to allow the spindle 60 to move upward until the top 68 of spindle 60 contacts the edge 114 of cutout zone 113. The short leg 74 (toe) of shackle 70 is now released from the locking hole 151 of top body 150. The top body 150 has a screw hole 152 below the locking hole 151 to allow a screw 120 to thread onto a screw hole 117 of spacer 110 for fastening the top body 150 to the spacer 110. As such, the top body 150 cannot be pulled away from spacer 110. The top body 150 also has a top body hole 153 in communication with the shackle hole 118 of spacer 110 and the spindle channel 6002 of spindle 60.

Locked Mode (FIGS. 1A-3B, 4, 5, 9A, 11 and 12)

Figure 5:
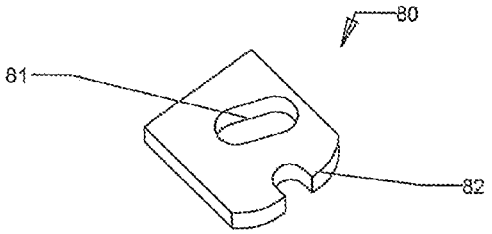
FIG. 5 is an isometric view of the latch.

So long as at least one of the clutches 50 is not aligned with an extended protrusion 61 of spindle 60, the spindle 60 cannot be moved upward. Furthermore, because the fork 82 of latch 80 is engaged with the lower surface 76 of the neck area 73 of long leg 7, the shackle 70 cannot be pulled upward. As seen in FIG. 5, the latch 80 has a slot 81 spaced from the fork 82. As seen in FIGS. 1A, 1B, 11 and 11B, the padlock 10 has a cylinder 160 placed inside the spindle 60. The cylinder 160 has two extended protrusions 161 on top of cylinder 160. A cam 170 having two holes 172 is placed on top of cylinder 160 so that the cam 70 is turned along with the cylinder 160. The cam 170 has an extended pin 171 arranged to engage with the slot 81 of latch 80. If the cam 170 cannot be turned, the latch 80 is in a locked position. As such, the fork 82 of latch 80 prevents the shackle 70 from being pulled upward to release the short leg 74 from the locking hole 150 of top body 150.

Each of the clutches 50 has one or more faulty notches 55 made on the extended inner ring 58. When the extended protrusion 61 of spindle 60 is not aligned with the opening gap 51 of an associated clutch 50, the extended protrusion 61 of spindle 60 is in contact to one of the faulty notches 55 of the associated clutch 50. The faulty notches 55 make the lock harder to pick. Furthermore, the bottom body 130 has an extended ring 136 extended from the contact surface 132, and the extended inner ring 43 of the last dial 40 is placed in the exterior of extended ring 136, rendering it difficult to peek into the internal mechanism of padlock 10.

Unlocked by Combination Code (FIGS. 2A-3B, 8A-10B, 16A and 16B)

To unlock the padlock 10 by the combination code, the user must align the dials 40 to the indicating line 154/133 of top body 150 and bottom body 130. When the dials 40 are turned, the clutches 50 are also turned as the teeth 41 of dials 40 are engaged with the wave-slots 53 of clutches 50. When all the dials 40 align to the lock open code, the opening gaps 51 of all the clutches 50 align with the extended protrusions 61 of spindle 60. The user can pull the shackle 70 upward along with the spindle 60 until the top 68 of spindle 80 hits the edge 114 of the cutout zone 113 of spacer 110. The upward movement of the spindle 60 causes each of the extended protrusions 61 to be engaged with the opening gap 51 of the associated clutch 50. The engagement prevents the clutches 50 from rotating relative to the spindle 60. The short leg 74 of shackle 70 is now released from locking hole 151 of top body 150, and the protrusion 75 of shackle 70 also moves out of the shackle-protrusion slot 115 of spacer 110 and into the shackle hole 118 between the top body 150 and the ring surface 116 of a ring 119. The shackle-protrusion slot 115 is made on the ring 119, which is extended from the inner surface of the shackle hole 118. As the short leg 74 of shackle 70 is released, the shackle 70 can rotate freely while the protrusion 75 of shackle 70 contacts the ring surface 116 of spacer 110. The ring surface 116 prevents the shackle 70 from being pushed downward so long as the short leg 74 of shackle 70 is not aligned with the locking hole 151 of top body 150. In the unlocked or open mode of padlock 10, the extended protrusions 61 of spindle 60 are always engaged with the opening gaps 51 of clutches 50. When the clutches 50 are stationary with the spindle 60, the user may reset the combination code. While the spindle 60 is in the upward position, the lower portion of the extended protrusion 61 is still engaged with the protrusion receiving slot 135 of bottom body 130, and the curved members 131 of bottom body 130 are still engaged with the curved slots 65 of spindle 60. This engagement prevents any rotational movement of the spindle 60 relative to the lock housing.

Reset Mode (FIGS. 2A-3B, 8A-8B, 13A-13B, 15A-15C and 16A)

Figure 15C:
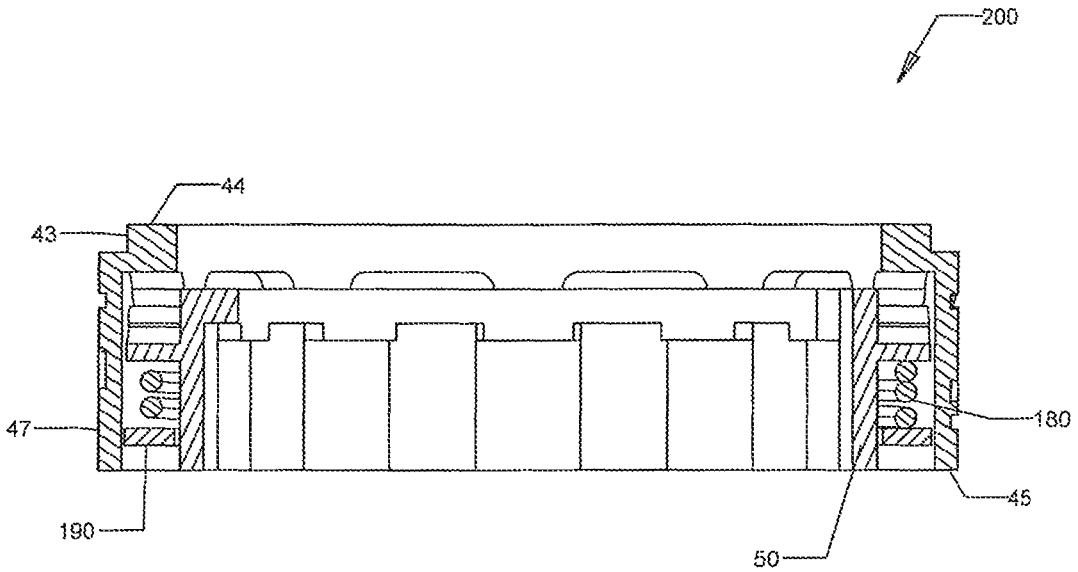
FIG. 15C is a cross sectional view of a dial-clutch assembly when the teeth of the dial are disengaged from the wave-slots of the clutch.
Figure 16A:
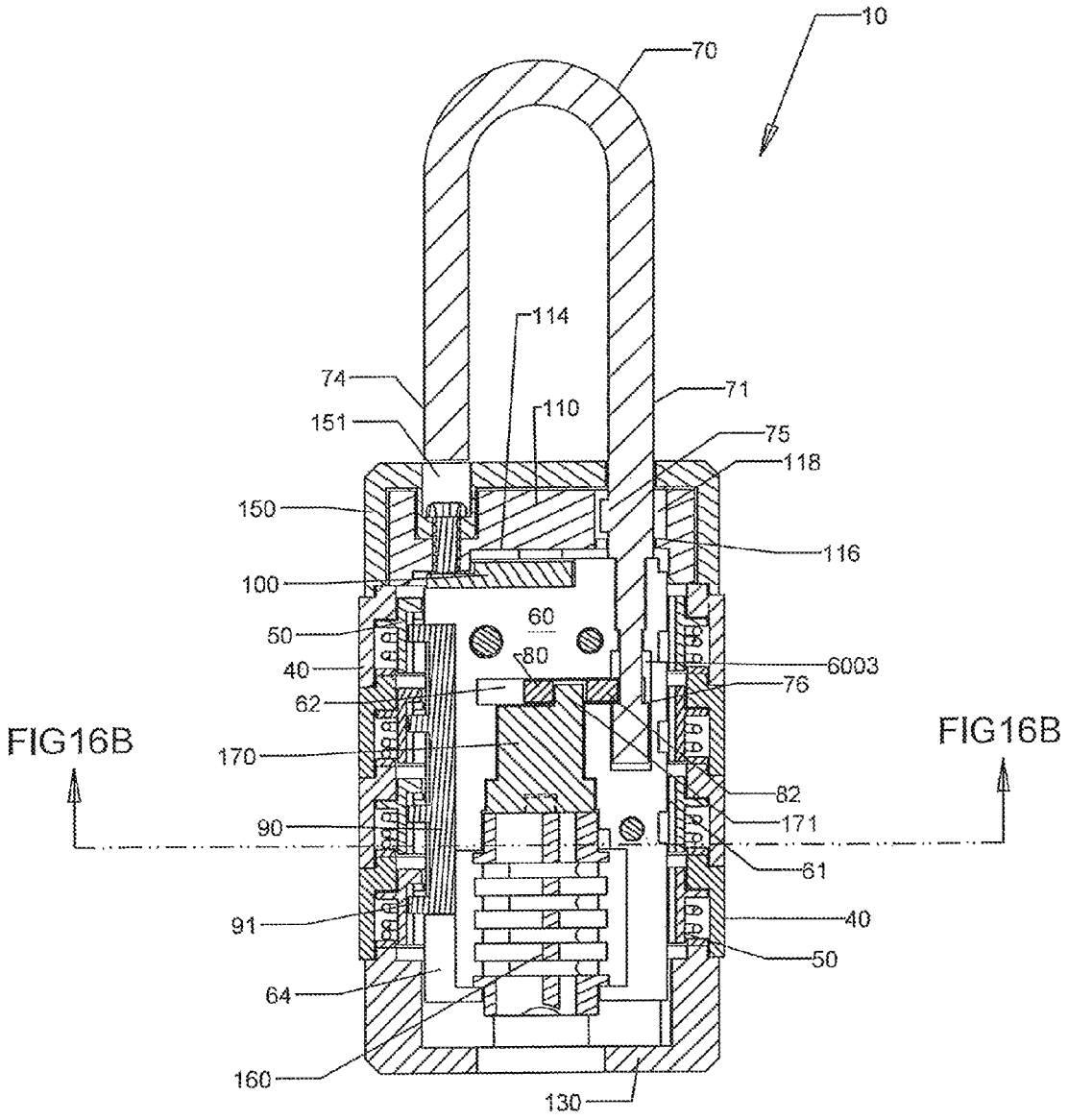
FIG. 16A shows a cross sectional side view of the padlock opened by a matching combination code.
Figure 16B:
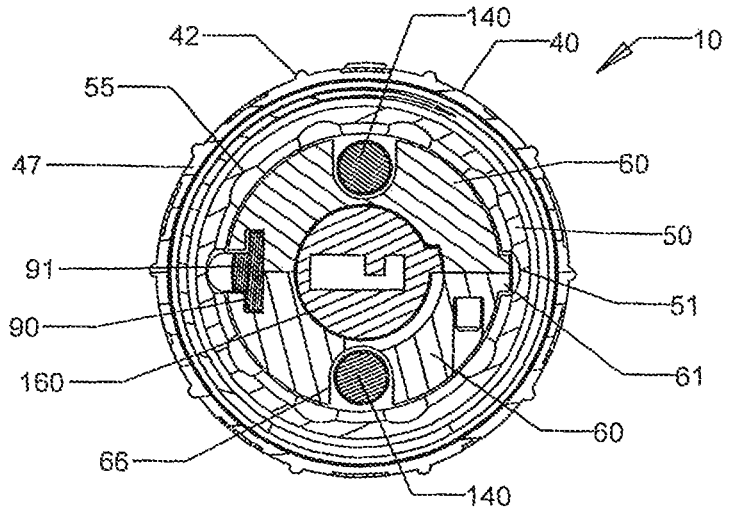
FIG. 16B shows a cross sectional bottom view of the padlock of FIG. 16A.
Figure 17B:
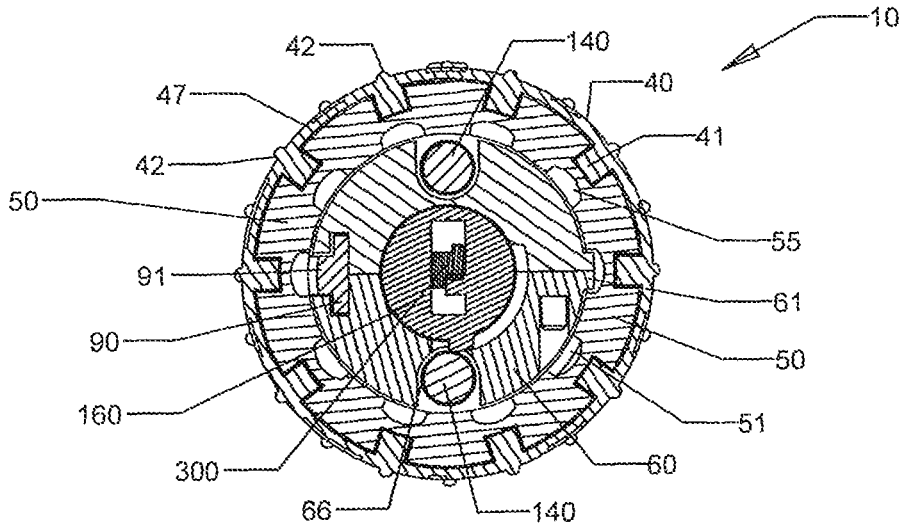
FIG. 17B shows a cross sectional bottom view of the padlock of FIG. 17A.
Figure 17A:
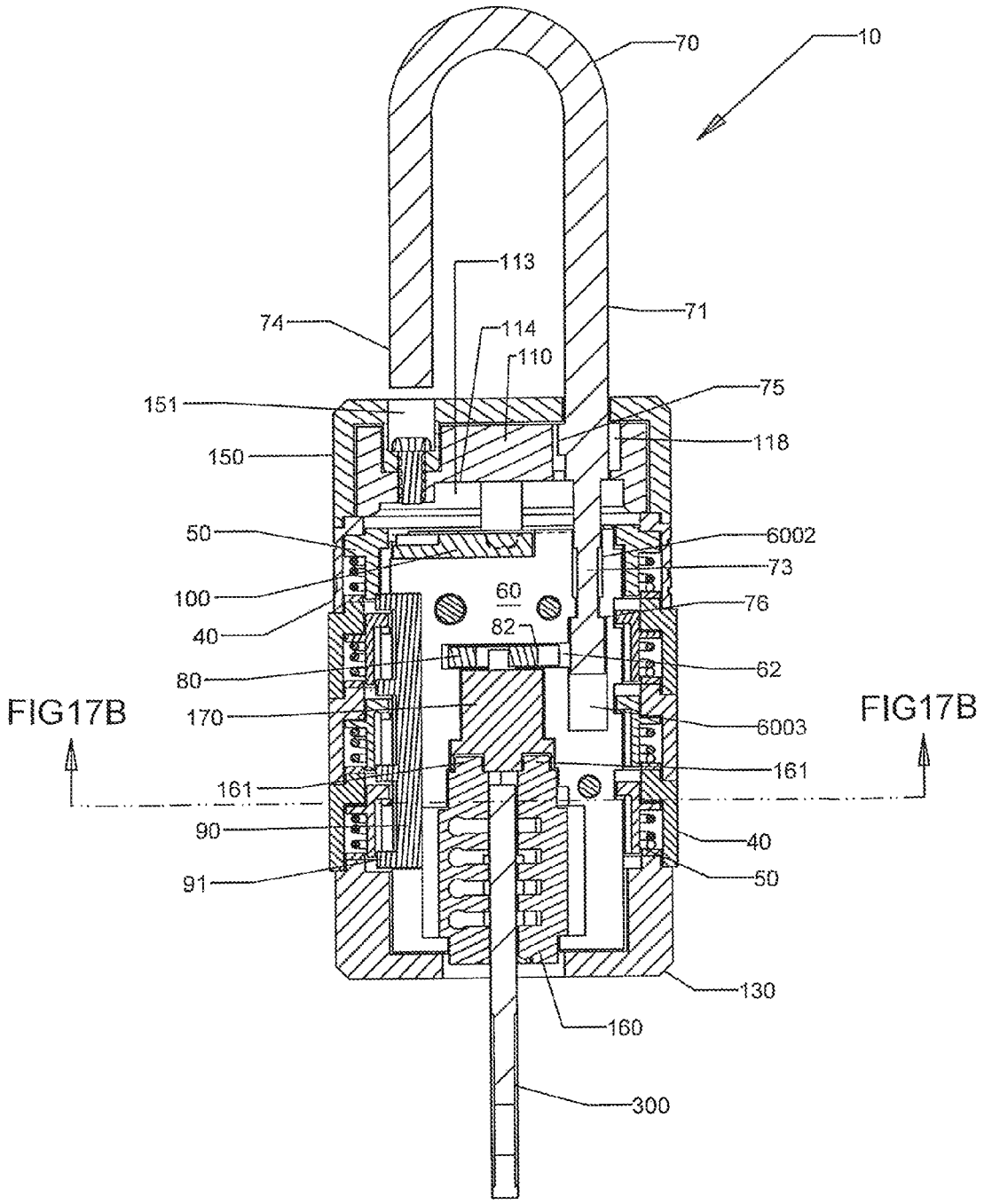
FIG. 17A shows a cross sectional side view of the padlock opened by a key.

When the lock is in the opened mode, the extended protrusions 61 of spindle 60 are engaged with the opening gaps 51 of clutches 50, preventing the clutches 50 from rotating relative to the spindle 60 and the lock housing. The user can rotate the dials 40 to reset the combination code. The dials 40 can only be rotated without the clutches 50, requiring the teeth 41 of each dial 41 to be moved out of the engaged wave-slots 53 of an associated clutch 50 until different wave-slots are engaged. This is possible only by pushing the associated clutch 50 downward against the urging force of a clutch spring 180 while a dial 40 is rotated. The downward movement of the clutch 50 compresses the clutch spring 180 as shown in FIG. 15C. The user must use a stronger force to rotate the dials while resetting the combination code. According to an embodiment of the present invention, each tooth 41 has a slope-like surface 46 on each side of the tooth 41 and each wave-slot 53 has a slope-like surface 54 on each side of the wave-slot. These slope-like surfaces make disengaging the teeth 41 from the wave-slots 53 easier.

In a padlock 10 where 10 digits on each dial 40 are used to set a combination code, there are ten teeth 41 on each dial 40 and ten wave-slots 53 on each clutch 50. Typically the user rotates each of the dials 40 one digit at a time until the desired combination aligns with the indicating line 154/133 of top body 150 and bottom body 130. To give the user a better grip on the dials 40, each dial 40 also has ten ribs 42 separating the ten digits. As seen in FIG. 15A, the separation ring 190 in each dial-clutch assembly 200 helps isolate the rotation of one dial 40 from another dial 40.

After resetting, the user rotates the shackle 70 so that its short leg 74 aligns with the locking hole 151 of top body 150 so that the protrusion 75 of shackle 70 also aligns with the shackle-protrusion slot 115 of space 110. The shackle 70 can be pushed down to engage the short leg 74 of shackle 70 with the locking hole 151 of top body 150. As the extended protrusions 61 of spindle 60 become disengaged with the opening gaps 51 of the clutches 50, the user can rotate the dials 40 along with the clutches 50 to place the lock in the locked mode.

Unlocked by Key Operating Mechanism (FIGS. 3A-5, 11, 12, 13A-13B, 17A and 17B)

The key operating mechanism is controlled by a wafer tumbler cylinder 160, the cam 170 and the latch 80. The cylinder 160 has two extended protrusions 161. The cam 170 has two holes 172 to receive the extended protrusions 161 of cylinder 160. The cam 170 also has an extended pin 171 arranged to engage the slot 81 of latch 80 which is placed inside the latch channel 62 of spindle 60. As a correct key 300 is inserted into the cylinder 160, the turn of the key 300 causes the cylinder 160 and the cam 170 to turn. As the cam 170 turns, the extended pin 171 of cam 170 drags the latch 80 sideward in a horizontal movement to move the fork 82 away from the lower channel portion 6003. The fork 82 of latch 80 is also disengaged from the lower surface 76 of the neck area 73 of shackle 70. As such, there is no blockage on the neck area 73 of shackle 70. However, the spindle 60 has no vertical movement because at least one of the opening gaps 51 of the clutches 50 is misaligned with the extended protrusions 61 of spindle 60. The shackle 70 can be pulled upward without the spindle 60 until the lower surface 76 of the neck area 73 hits the stop wall 69 of the lower channel portion 6003 of spindle 60. The short leg 74 of shackle 70 is thus released from the locking hole 151 of top body 150. Since the clutches 50 are not engaged with the spindle 60, the clutches 50 can be caused to turn along with the dials 40 even when the padlock 10 is unlocked by the correct key 300.

The present invention provides a dual locking padlock wherein the lock body, the cylinder, the clutches, the dials and the spindle are concentric to a center line.

Although the present invention has been described with respect to one or more embodiments thereof, it will be understood by those skilled in the art that the foregoing and various other changes, omissions and deviations in the form and detail thereof may be made without departing from the scope of this invention.

What is claimed is:

1. A padlock operable in a locked mode an opened mode and a reset mode, comprising:

a shackle having a heel and a toe;

a lock housing configured to store the heel of the shackle, the lock housing comprising a top portion, a middle portion and a bottom portion, wherein the heel of the shackle can be partially released from the lock housing from a first shackle position to a second shackle position;

a spindle disposed inside the lock housing and arranged to provide a code locking mechanism, the code locking mechanism configured to operate the padlock in the locked mode and in the opened mode based on a combination code, the spindle comprising a cylindrical surface;

a plurality of clutches rotatably mounted on the cylindrical surface of the spindle;

a plurality of dials mounted in the middle portion of the lock housing in relationship to the clutches, each of the dials associated with a different one of the clutches to form a dial-clutch pair, the dials having a plurality of symbols to form the combination code; and an overriding mechanism disposed in relationship to the spindle, the overriding mechanism activatable by a key to cause the padlock to operate in the opened mode, wherein the shackle is in the first shackle position when the padlock is operated in the locked mode, and the shackle is in the second shackle position when the padlock is operated in the opened mode, wherein each of the clutches comprises an extended outer ring having thereon a plurality of clutch slots, and each of the dials comprises an extended inner ring having thereon a plurality of teeth, each clutch slot dimensioned to receive a tooth, such that the teeth of the dial are arranged to engage with said plurality of clutch slots of the associated clutch in the dial-clutch pair, so as to control rotational movement of said clutch relative to the spindle at least when the padlock is operated in the locked mode, and wherein each of the teeth has a sloping surface on both side of the tooth and each of the clutch slots also has a sloping surface on both side of the clutch slot so as to facilitate rotation of the dial relative to the associated clutch in the dial-clutch assembly when the padlock is operated in the reset mode.

2. The padlock according to claim 1, wherein the heel of the shackle comprises a neck area, and said padlock further comprises a latch having a fork arranged to engage the neck area of the heel so as to prevent the shackle from moving away from the first shackle position when the padlock is operated in the locked mode.

3. The padlock according to claim 2, wherein the spindle comprises a spindle channel for storing the heel, the spindle channel having a channel portion for storing part of the neck area of the heel, and the latch is disposed in relationship to the channel portion, and wherein the spindle further comprises a cam arranged to engage the latch so as to keep the fork in an engaging relationship with the neck area of the heel.

4. The padlock according to claim 3, wherein the overriding mechanism can be activated by the key, causing the cam to disengage the fork of the latch from the neck area of the heel, allowing the shackle to move from the first shackle position to the second shackle position.

5. The padlock according to claim 1, wherein the bottom portion of the lock housing comprises a bottom body, and wherein the spindle is movably mounted on the bottom body such that the spindle can be caused to move upward toward the top portion of the lock housing in a vertical movement from a first spindle position to a second spindle position, and wherein each of the clutches has an inner surface and an extended inner ring extended from the inner surface, the extended inner ring having a ring thickness and an opening gap made on the extended inner ring through the ring thickness, and the spindle comprises a plurality of extended protrusions, each extended protrusion associated with a clutch such that the extended inner ring of the clutch prevents the spindle from moving upward when the extended protrusion is misaligned with the opening gap of the associated clutch.

6. The padlock according to claim 5, wherein when the padlock is operated in the locked mode, the dials can be rotated relative to the spindle to change the combination code and the clutches are caused to rotate along with the dials, such that when the combination code matches a predetermined code, the opening gap of each of the clutches aligns with an associated extended protrusion of the spindle, allowing the spindle to move from the first spindle position to the second spindle position when the shackle is pulled upward from the first shackle position to the second shackle position, causing the padlock to operate in the opened mode.

7. The padlock according to claim 6, wherein the plurality of dials form a dial stack comprising a first dial and a last dial, the last dial positioned in contact with the bottom body of the lock housing, and wherein the top portion of the lock housing comprises a top body mounted on the first dial and a spacer fixedly mounted on the top body between the top body and the spindle, the spacer having a shackle hole dimensioned to receive the heel of the shackle, the top body comprising a locking hole and a top body hole, the locking hole dimensioned to receive the toe of the shackle, the top body hole in communication with the shackle hole of the spacer and the spindle channel of the spindle for placement of the heel of the shackle.

8. The padlock according to claim 7, wherein the shackle hole of the spacer has an inner surface and an extended ring extended therefrom, the extended ring having a shackle-protrusion slot made thereon and a ring surface facing the top body, and wherein the spacer has a cutout zone dimensioned to receive the spindle, allowing the spindle to move between the first spindle position and the second spindle position, and wherein the heel of the shackle has a shackle protrusion positioned in relationship to the shackle-protrusion slot such that when the shackle is in the first shackle position, the shackle protrusion is located between the extended ring and the spindle, and when the shackle is pulled upward from the first shackle position to the second shackle position, the shackle protrusion moves through the shackle-protrusion slot so that when the spindle is in the second spindle position, the shackle protrusion is located in the shackle hole between the extended ring and the top body.

9. The padlock according to claim 8, wherein when the padlock is operated in the opened mode, the shackle can be rotated so as to move the toe of the shackle away from the locking hole of the top body and to move the shackle protrusion away from the shackle-protrusion slot, and when the shackle protrusion is moved away from the shackle-protrusion slot, the extended ring of the spacer prevents the shackle from moving downward.

10. The padlock according to claim 7, wherein the bottom body comprises a plurality of screw holes, the spindle has a cylindrical surface and a plurality of screw passing slots made on the cylindrical surface, and the spacer further comprises a plurality of screw-receiving holes, and the lock housing further comprises screws arranged to fasten the spacer to the screw holes on the bottom body via the screw receiving holes of the spacer through the screw passing slots of the spindle.

11. The padlock according to claim 5, wherein when the spindle is in the second spindle position, each of the extended protrusion of the spindle is engaged with the opening gap of one of the clutches, preventing the clutches from rotating relative to the spindle.

12. The padlock according to claim 11, wherein when the spindle is in the second spindle position, the dials can be rotated relative to the clutches to change the combination code.

13. The padlock according to claim 12, wherein each of the dials has an outer ring having an outer surface arranged for placing the plurality of symbols to form the combination code, the outer ring dimensioned to receive a clutch, and wherein each dial-clutch assembly comprises a separation ring positioned within the outer ring of the dial, and a helical spring positioned within the outer ring between the separation spring and extended outer ring of the clutch, such that when the dial in the dial-clutch assembly is rotated relative to the clutch, the teeth of the dial are configured to push the clutch toward the separating ring and to compress the helical spring so as to allow the teeth to disengage from the clutch slots.

14. The padlock according to claim 5, wherein the spindle further comprises a ratchet slot spaced from the extended protrusions of the spindle, the ratchet slot dimensioned to receive a ratchet plate having a plurality of tips, and wherein the inner surface of each of the clutches has a plurality of ratchet-receiving slots arranged to engage with one of the tips of ratchet plate so as to produce a clicking sound when the clutch is rotated relative to the spindle.

15. The padlock according to claim 5, wherein the extended inner ring of each of the clutches further comprises a plurality of faulty notches made through a part of the ring thickness, the faulty notches spaced from the opening gap, such that when the extended protrusion of spindle is misaligned with the opening gap of the associated clutch, the extended protrusion of the spindle is in contact to one the faulty notches on the associated clutch.

* * * * *